United States Patent [19]

Klimashko et al.

[11] Patent Number: 4,606,414

[45] Date of Patent: Aug. 19, 1986

[54] PERCUSSIVE AIR TOOL

[75] Inventors: Vladimir V. Klimashko; Nikolai P. Chepurnoi, both of Novosibirsk; Vladimir D. Makeev, Minsk; Vladimir P. Naboko, Minsk; Alexandr D. Filonov, Minsk; Petr N. Svita, Minsk, all of U.S.S.R.

[73] Assignee: Institut Gornogo Dela Sibirskogo Otdelenia Akademii Nauk SSSR, Moscow, U.S.S.R.

[21] Appl. No.: 354,753

[22] Filed: Mar. 4, 1982

[51] Int. Cl.[4] ..... B25D 17/08

[52] U.S. Cl. ..... 173/128; 173/134; 279/102; 403/334

[58] Field of Search ..... 173/128, 134, 90; 279/50, 51, 102, 103; 403/334, 290, 348, 349, 343, 289

[56] References Cited

U.S. PATENT DOCUMENTS

| | | | |
|---|---|---|---|
| 104,884 | 6/1870 | Reinshagen | 403/349 |
| 308,639 | 12/1884 | Stevens | 403/290 |
| 953,896 | 4/1910 | Clattenburg | 403/343 |
| 1,097,545 | 5/1914 | Grines | 173/128 |
| 1,606,188 | 11/1926 | Selah | 16/DIG. 30 |
| 1,859,611 | 5/1932 | Yungling | 173/128 |
| 1,928,707 | 10/1933 | Stevens | 173/135 |
| 2,094,184 | 10/1937 | Noble | 173/128 |
| 2,098,581 | 11/1937 | Janes | 403/289 |
| 2,936,736 | 5/1960 | Werstein | 173/104 |
| 3,123,156 | 3/1964 | Gapstur | 173/48 |
| 3,508,773 | 4/1970 | Coberly et al. | 403/334 X |
| 4,262,917 | 4/1981 | Ottestad | 279/4 |

FOREIGN PATENT DOCUMENTS 2157259 11/1972 Fed. Rep. of Germany .

*Primary Examiner*—Donald R. Schran
*Assistant Examiner*—James L. Wolfe
*Attorney, Agent, or Firm*—Burgess, Ryan and Wayne

[57] ABSTRACT

A hollow housing has a piston hammer arranged for reciprocation therein. The hammer has a rear end chamber, an air distributing valve secured in the rear end portion of the housing and adapted to be received by the rear end chamber of the piston hammer. A headpiece is secured to the forward end portion of the housing and subjected to impact of the piston hammer. A retainer embraces by at least one of its ends, the forward end portion of the housing and is disposed coaxially relative to the housing and the headpiece to ensure clamping of the forward end portion of the housing between the retainer and the headpiece.

4 Claims, 7 Drawing Figures

PERCUSSIVE AIR TOOL

FIELD OF THE INVENTION

The present invention relates to air tools, and more specifically to percussive air tools.

INDUSTRIAL APPLICABILITY

The invention can find application in tools for sinking metal tubing used as the casings of horizontal or inclined communication lines layed by trenchless methods underground, beneath streets, railroads and highways, as well as for tools to drive metal tubular piles vertically or at an angle to the horizontal into the ground.

BACKGROUND OF THE INVENTION

There has been used, for driving metal tubes into the ground, percussive air tools of relatively low driving power, and capable of driving tubes of rather small diameter.

An increase in the driving power of such percussive air tools has been until now hampered by the fact that traditionally accepted construction of their housings the results in a less technologically efficient and more labour consuming manufacture and an increase in the dimensions thereof.

A percussive air tool is known (cf., e.g., USSR Inventor's Certificate No. 236,350; IPC E21 B 7/00) for driving into the ground metal tubes serving as casings of underground communication lines and sinking piles.

This percussive air tool comprises a housing accommodating in the interior thereof a reciprocating hammer having an end chamber, and an air distributing valve means adapted to be received by the end chamber of the hammer and secured in the rear end portion of the housing. Jammed in the forward end portion of the housing by means of a conical connection is a headpiece hermetically closing the interior of the housing and subjected to the percussions of the hammer.

Prior to tube sinking the forward end portion of the housing is rigidly connected to the tube to be driven. Impact of the hammer is transmitted to the tube via the headpiece and the housing. Under the action of the impact the tube and the percussive air tool are sunk into the ground. The friction force arising between the tube and the ground prevents the tube from moving in the opposite direction due to reaction or recoil of the air tool.

A disadvantage of this percussive air tool resides the complications encountered during the manufacture of its housing, which is shaped as a thin-wall cylinder having a massive thick-wall forward end portion intended for mounting the headpiece.

This disadvantage becomes even more pronounced with an increase in the power of the air tool and consequently the diameter of its housing.

The thickened housing wall in the portion thereof adjoining the headpiece is absolutely essential because the conical connection of the housing with the headpiece is subject to considerable radial loads during operation which tend to rupture the housing.

Also known is a percussive air tool (cf. W.German Pat. No. 2,157,259; IPC E21 B 7/00, published 1973) wherein the abovementioned disadvantage is obviated. This tool serves for sinking wells and is comprised of a cylindrical hollow housing, a hammer reciprocating inside the housing and having an end face chamber, an air distributing valve secured in the rear end portion of the housing and adapted to be received by the end face chamber of the hammer, and a headpiece disposed in the forward end portion of the housing and subjected to impacts of the hammer.

The housing of this percussive air tool is fashioned as a continuous cylinder and is connected with a head portion by means of a threaded connection.

The head portion accommodates a headpiece or anvil capable of a certain amount of axial displacement, whereas the outer side of the head portion may hold a replaceable tool, such as a well expander.

The housing and the head portion of the percussive air tool are simple to manufacture.

A disadvantage inherent in the above construction resides in the low dependability of the threaded connection, which tends to loosen or even be destroyed due to the formation and growth of free play between the threads of such a connection.

The above disadvantage is further aggravated when driving tubes horizontally or obliquely and additional loads are transmitted to the threaded connection.

In addition, such a threaded connection must be manufactured to close thereby resulting in higher production costs involved.

The foregoing advantage become more tangible in air tools of higher driving power, that is devices featuring larger housing diameter.

SUMMARY OF THE INVENTION

It is therefore an object of the invention to improve the reliability of percussive air tools, as well as to extend the service life thereof.

Another object is to raise the driving power of a percussive air tool along with increased reliability and extended service life thereof.

One more object is to provide a percussive air tool having a housing which is simple to manufacture.

These objects are attained in a percussive air tool comprising a hollow housing, a piston hammer arranged for reciprocations inside the housing and having a rear end chamber, an air distributing valve means secured in the rear end portion of the housing and adapted to be received by the rear end chamber of the piston hammer, a headpiece secured in the forward end portion of the housing and subjected to impacts of the piston hammer, and a retainer. According to the invention, the retainer embraces at least by one end thereof the forward end portion to the housing to be disposed coaxially relative to the housing and the headpiece to thereby ensure clamping of the forward end portion of the housing between the retainer and the headpiece.

This structural arrangement enables the construction of a percussive air tool having increased power, reliability and durability as well as simplifying manufacture thereof.

Alternatively, another arrangement is possible wherein the retainer embraces the forward end portion of the housing by its entire inner surface.

Preferably, the retainer is connected to the housing by means of a self-jamming connection, an inner conical surface of the retainer and an outer conical surface of the housing being tapered forward of the housing; or the retainer may be connected to the housing along tightly fitting cylindrical surfaces and fixed by means of a collar arranged, for example, on the outer surface of the housing and intended to prevent displacement of the retainer toward the rear end of the housing.

This arrangement of the percussive air tool permits manufacturing the housing thereof from a thin-wall tube and enables use for such a manufacture of deep boring tools because such a housing has but a small tapering of the inner wall thereof toward the forward end.

Another modification of the percussive air tool is possible wherein the retainer is adapted to embrace the headpiece by another end thereof for rigid connection therewith.

The the retainer is connected with the housing and with the headpiece by means of a self-jamming conical connection with mating surfaces of the retainer and the housing is tapered toward the rear end portion of the housing, while mating conical surfaces of the retainer and the headpiece are tapered in the opposite direction.

It is also possible for the housing to be connected with the headpiece along a cylindrical surface, which allows a housing of shorter length with a cylindrical continuous interior wall made from a thin-wall tube quickly and at low cost by means of boring tools.

Preferably, the self-jamming connection joining the retainer with the housing is fashioned as a bayonet lock in the form of longitudinal slots arranged on the mating conical surfaces to run in parallel with the axis of the housing, the resulting projections of the housing being coincident with the grooves of the retainer.

Advisably, the self-jamming conical connection of the retainer with the headpiece is provided with a conical sleeve interposed between the retainer and the headpiece and jammed therebetween to be removed therefrom axially of the housing.

The aforedescribed modifications of the percussive air tool provide for fast disconnection and replacement of a faulty retainer, housing or headpiece.

Preferably, the wall of the forward end portion of the housing is provided with at least one longitudinal through slit enhancing the radial pliability of the foward end portion of the housing.

This enables a more reliable clamping of the housing between the retainer and the headpiece even if their radial dimensions are held to a lesser degree of accuracy.

BRIEF DESCRIPTION OF THE DRAWINGS

The ivention will now be described in greater detail with reference to specific embodiments thereof taken in conjuction with the accompanying drawings, in which.

DETAILED DESCRIPTION OF THE INVENTION

Figure 1:
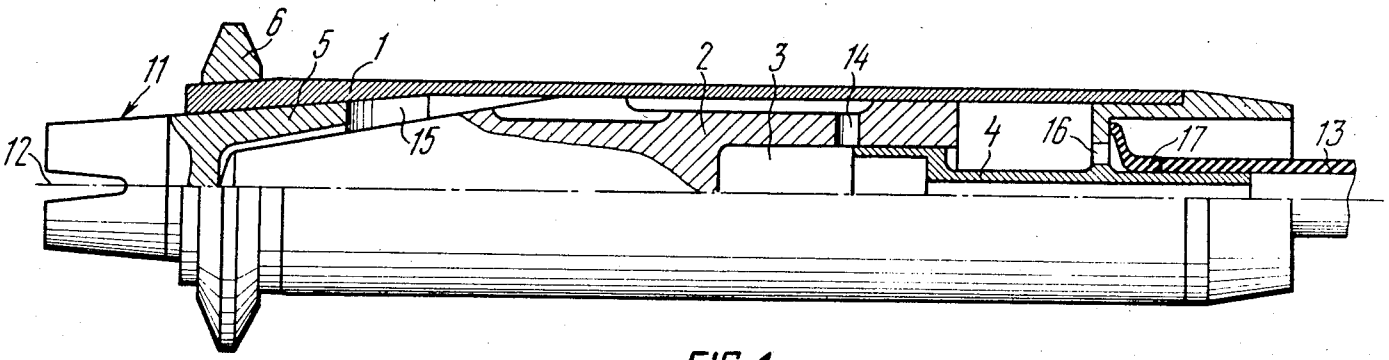
FIG. 1 is a longitudinal sectional view of a percussive air tool according to the invention featuring a retainer that embraces a housing by the entire inner surface thereof and is connected thereto by means of a self-jamming conical connection.

With reference to FIG. 1, there is shown a percussive air tool comprising a housing 1, a piston hammer 2 adapted to reciprocate inside the housing and having a rear end chamber 3. The tail portion of the housing 1 accommodates an air distributing valve means 4 adapted to be received by the rear end chamber 3 of the piston hammer 2 during reciprocations thereof. The forward portion of the housing 1 is provided with a headpiece 5 subjected to the impact of the piston hammer 2, and a ring retainer 6.

According to the invention, the ring retainer 6 embraces the forward portion of the housing 1 and being disposed coaxially relative to the housing 1 and the headpiece 5 ensures that the forward portion of the housing 1 is clamped between the ring retainer 6 and the headpiece.

In the modification of the percussive air tool shown in FIG. 1 the housing 1 is connected with the ring retainer 6 and the headpiece 5 by a self-jamming connection the conical surfaces of which are tapered towards the side opposite to the rear portion of the housing 1.

Figure 2:
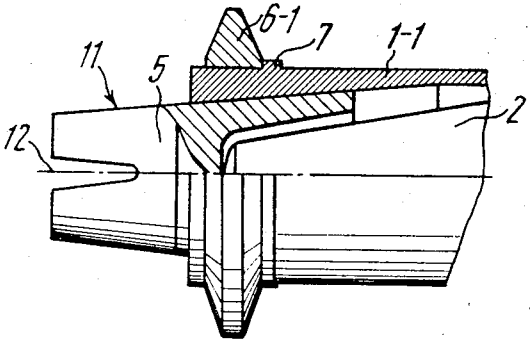
FIG. 2 shows a longitudinal sectional view of a forward end portion of the percussive air tool according to the invention wherein the retainer is adapted to embrace the housing and is connected thereto along a generally cylindrical surface.

FIG. 2 illustrates an alternative connection of a housing 1-1 with a ring retainer 6-1 wherein the outer surface on the housing is of generally cylindrical shape. In this case the ring retainer 6-1 is fitted tightly onto the housing 1-1 and fixed against possible displacement caused by percussive impacts by a collar 7.

In these two arrangements of the percussive air tool the interior of the housing thereof is slightly tapered or narrowed toward its forward end. Conventiently, the housing is manufactured on deep boring machines without the need for the boring tool to completely exit the interior of the bored housing. Alternatively, the housing can be fabricated from a thin-wall pipe having a small setting in the forward portion thereof, or else from an unset pipe of a little larger wall thickness.

The abovedescribed arrangements of a percussive air tool wherein the ring retainer 6 or 6-1 is adapted to embrace the housing 1 or 1-1 by the entire inner surface thereof is advantageous in that the ring retainers 6 and 6-1 are simple in design and manufacture.

Referring to FIGS. 3 to 7, there are shown alternative modifications of a percussive air tool differing from those described heretofore by the structural arrangement of their forward portions, particularly by the fact that the housing, being straight on the inside, is connected with the headpiece on the cylindrical surface thereof.

Figure 3:
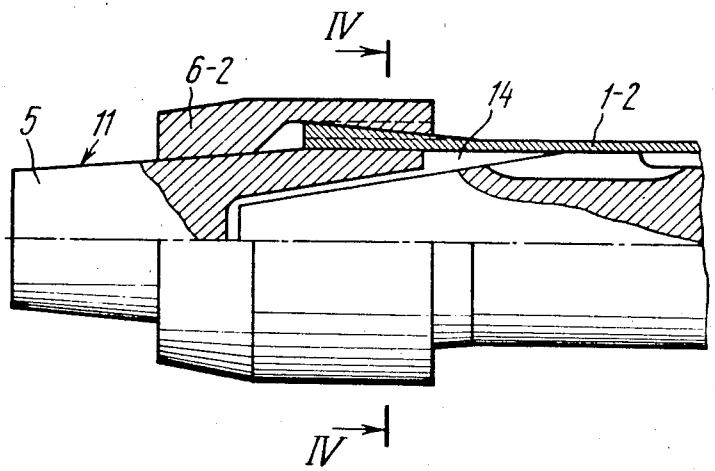
FIG. 3 represents a longitudinal sectional view of another modification of the percussive air tool according to the invention wherein the retainer is adapted to embrace by one end thereof the housing and by the other end thereof a headpiece, self-jamming conical joints being used as a means of connection.

As best seen in FIG. 3, a retainer 6-2 is connected to a housing 1-2 and headpiece 5 by means of a self-jamming joint, the mating conical surfaces on the exterior of the housing 1-2 and retainer being tapered toward the rear end of the housing, whereas the mating conical surfaces of the headpiece 5 and retainer 6-2 are tapered in the opposite direction.

For a more convenient assembling, disassembling and replacement of elements, the self-jamming conical joint connecting the retainer 6-2 with the housing 1-2 is fashioned as a bayonet lock. To this end, the mating conical surfaces of the housing 1-2 and retainer 6-2 are provided with longitudinal slots 8 (FIG. 4), the slots being arranged in such a manner that projections of the housing 1-2 are placed in registration with recesses of the retainer 6-2.

Figure 4:
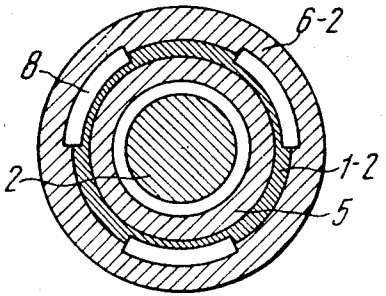
FIG. 4 is a cross-section taken along the line IV—IV of FIG. 3, showing a modification of the percussive air tool according to the invention wherein the self-jamming conical joint is fashioned as a bayonet lock.
Figure 7:
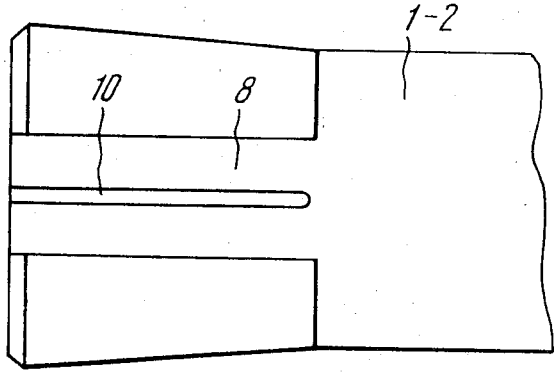
FIG. 7 illustrates the forward end portion of the housing provided with a longitudinal through slit enhancing the radial pliability of this portion of the housing.

In order to assemble the percussive air tool, it is necessary to axially align the retainer 6-2 and the housing 1-2 for the projections of the housing 1-2 to be in registration with the recesses of the retainer 6-2 and then introduce the forward portion of the housing 1-2 into the retainer 6-2 and turn the housing to engage the conical surfaces as shown in FIG. 4. Thereafter, the retainer 6-2 must be displaced away from the forward end of the housing 1-2 until the connection is jammed. The headpiece 5 must then be inserted into the housing 1-2 from the rear end thereof to be moved toward the forward end until it is jammed in the retainer 6-2.

Replacement of the retainer, the housing or the headpiece, as well as their fast assembly can alternatively be facilitated by arranging between a retainer 6-3 (FIGS. 5, 6) and headpiece 5 a conical sleeve 9 consisting of several parts and disengageable axially of the percussive air tool.

Figure 6:
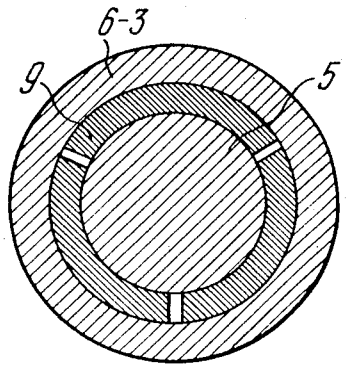
FIG. 6 is a cross-section taken along the line VI—VI of the percussive air tool shown in FIG. 5 provided with the conical sleeve jammed between the retainer and the headpiece for removal axially of the housing.
Figure 5:
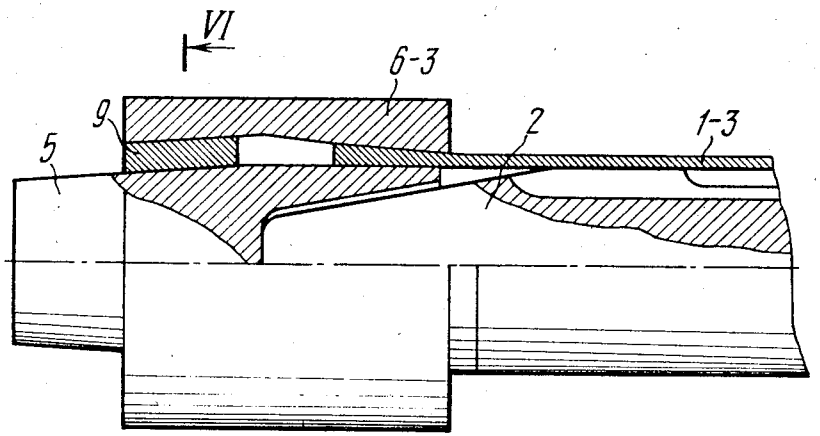
FIG. 5 is a longitudinal sectional view of the percussive air tool according to the invention featuring a self-jamming conical connection provided with a conical sleeve jammed between the retainer and the headpiece.

The modification according to FIG. 6 is assembled in the following order. The retainer 6-3 is first attached to the housing 1-3 until it is jammed thereagainst. Then parts of the conical sleeve 9 are collected in the retainer 6-3 and the headpiece 5 is inserted into the housing until it is jammed against the sleeve 9.

All the conical connections of the percussive air tool must be pressure-fitted subsequent to assembling by the application of an axially directed static or pulse force to provide for better jamming.

A more reliable jamming of the housing 1–2 (FIG. 3) between the retainer 6-2 and headpiece 5 is obtained by preferably providing a through longitudinal slit 10 (FIG. 7) running along the slot 8 in the forward end portion of the housing 1-2 this enhances the radial pliability of the forward end.

The percussive air tool according to the invention operates in the following manner.

The protruding conical portion 11 (FIG. 1) of the headpiece 5 is wedged into a pipe to be driven either directly or by means of an adapter. The percussive air tool may be connected with the pipe to be driven by either arranging the walls thereof to be placed into a groove 12 provided at the extremity of the headpiece 5 or by a groove-and-tongue arrangement. Alternatively, the pipe may be driven by the retainer 6.

The preparation of the percussive air tool for operation includes connecting it by a hose 13 to a source of compressed air, normally a mobile air compression unit.

At the disposition of parts of the percussive air tool best seen in FIG. 1, compressed air from the source of compressed air (not shown) is conveyed through the hose 13 and a passageway of the air distributing valve means 4 into the chamber 3 which is in fact the rear end working chamber of the percussive air tool. From the rear end chamber 3 the compressed air is passed through radial holes 14 of the piston hammer 2 into a front working chamber 15 which is arranged in an annular space between the housing 1 and the piston hammer 2.

Due to the fact that the working surface area of the piston hammer 2 facing the chamber 15 is larger than the surface area of the rear end chamber 3, an equal pressure in the two chambers 3 and 15 will result in the piston hammer 2 tending to move relative to the housing 1, or perform a return stroke (to the right if viewed in FIG. 1).

After the radial holes 14 of the piston hammer 2 are covered by the forward portion of the air distributing valve means 4 to cut off the supply of air into the working chamber 15, the piston hammer 2 continues to move under the action of expanding air in this chamber. Upon the radial holes 14 of the piston hammer 2 having passed the larger diameter of the air distributing valve means 4 to assume a position over the smaller diameter thereof, the air escapes outside from the working chamber 15 via the radial holes 14, an annular space between the smaller diameter of the air distributing valve means and the inner surface of the piston hammer 2, and then via through holes 16 and a flexible valve 17. Under the action of the air compressed in the rear end chamber 3, the piston hammer 2 is stopped without making an impact against the valve means 4.

The compressed air in the chamber 3 causes the hammer 2 to make a working stroke and deliver an impact against the headpiece 5 which transmits the impact to a pipe being driven.

The cycle is repeated and the impacts drive the pipe further into the ground. The reaction or recoil of the percussive air tool is damped by friction between the pipe being driven and the ground.

Therefore, the impact of the piston hammer 2 (FIGS. 1 and 2) against the headpiece 5 act to move the pipe forward.

Clamping of the housing 1 (1-1) between the retainer 6 (6-1) and the headpiece 5 is enhanced due to these elements tending to remain in place under the forces of inertia.

The arrangement of the percussive air tool illustrated in FIGS. 1 and 2 is structurally simple, reliable and durable. It can be fabricated from thin-wall pipes by deep boring tools. Another important advantage resides in the fact that it can be quickly assembled and disassembled, or the retainer 6 (6-1), the headpiece 5 or the housing 1 (1-1) can be easily replaced.

The use of percussive air tool shown in FIG. 1 is preferable when it contacts a pipe being driven by way of the retainer 6, that is when percussions of the hammer 2 are transmitted to the pipe through the housing 1 and retainer 6.

In all other cases, when the precussive air tool is connected to the pipe being driven by way of the headpiece, that is when the retainer 6-1 does not transmit the impacts, it is more preferable to use the modification illustrated in FIG. 2.

The modifications of the percussive air tool shown in FIGS. 3 to 6 are preferable in such cases.

Under the action of impact the headpiece 5 moves the retainer 6-2 (6-3) forward thereby enhancing a clamping effect therebetween. This displacement of the retainer 6-2 (6-3) also enhances the clamping effect between the housing 1-2 (1-3) and headpiece 5.

Having in view the foregoing, in the percussive air tool according to the invention the conical connections are arranged in such a manner that the clamping effect is increased during operation of the percussive air tool, which improves its reliability. Under normal working loads it fails to disassemble spontaneously.

The modifications with reference to FIGS. 3 to 6 are also dependable, durable and simple in construction.

Although the retainer 6-2 (6-3) are not as simple to manufacture as in the preceding arrangement, the housing 1-2 (1-3) is shorter in length and less complicated; it can be fabricated from a thin-wall pipe by using boring tools.

When the housing 1-2 (FIGS. 3 and 4) of the percussive air tool has wall thickening in the forward portion thereof, it is advisable to make use of a bayonet lock connection; such a connection enabling the assembly of the housing 1-2 with the retainer 6-2 from the forward portion of the percussive air tool.

When the forward end of the housing 1-3 (FIGS. 5 and 6) is continuous in configuration, the conical sleeve 9 is preferable, which makes it possible to dispense with a bayonet lock arrangement.

In both of the latter cases the provision of the longitudinal slit 10 (FIG. 7) in the housing 1-2 (1-3) ensures a more reliable jamming thereof between the retainer 6-2 (6-3) and the headpiece 5 and requires less manufacturing accuracy due to enhanced radial pliability of the housing 1-2 (1-3).

What is claimed is:

1. A percussive air tool comprising:

a hollow tubular housing having a forward and a rear end portion; a piston hammer disposed inside said housing for axial reciprocation therein, said piston hammer having a rear end chamber; an air distributing valve arranged in the rear end portion of said housing and received by said rear end chamber of said piston hammer; a headpiece fixedly secured in the forward end portion of said housing and subjected to impact of said piston hammer;

a separate retainer received on and surrounding the forward end portion of said housing and disposed coaxially with said housing and said headpiece to improve radial rigidity and strength of the forward end portion of said housing and to connect said forward end portion to a member to be driven;

a self-jamming conical joint for interconnecting the forward end portion of said housing and said retainer, said self-jamming conical joint including an outer surface on said headpiece which is tapered toward the forward end portion of said housing, an inner surface of said housing which is tapered toward the forward end portion thereof for matingly receiving said outer surface of said headpiece, so as to increase the self-jamming effect between the retainer, housing and headpiece when said said piston hammer impacts said headpiece, and to seal off an inner space of the housing at the headpiece as an impact is transmitted from the piston hammer through the headpiece and the housing to said retainer.

2. A percussive air tool according to claim 1, wherein an outer surface of said housing is tapered toward the forward end portion thereof and an inner surface of said retainer is tapered toward the forward end portion of said housing in mating relation with said outer tapered surface of said housing to clamp said housing between said retainer and said headpiece in a self-jamming manner.

3. A percussive air tool comprising:

an elongated hollow tubular housing having a forward and a rear end portion; a piston hammer disposed inside said housing for axial reciprocation therein, said piston hammer having a rear end chamber; an air distributing valve arranged in a rear end portion of said housing and received by said rear end chamber of said piston hammer; a headpiece fixedly secured in the forward end portion of said housing and mating therewith along the adjacent tubular surface forward end portion of said housing, said headpiece being subjected to impact of said piston hammer;

a separate ring-shaped retainer having one end received on and surrounding the forward end portion of said housing to raise its radial rigidity and strength, the other end of said retainer received on and surrounding said headpiece; and a self-jamming conical joint for interconnecting the forward end portion of said housing and said retainer, said self-jamming conical joint including an outer surface of said housing which is tapered toward the rear end portion of said housing, an inner surface on said retainer which is tapered toward the rear end portion of said housing for matingly engaging with said outer surface of said housing, an outer surface on said headpiece which is tapered toward the forward end portion of said housing and an inner surface on said retainer which is tapered toward the forward end portion of said housing for matingly engaging with said outer surface of said headpiece, to clamp said housing between said retainer and said headpiece and to increase the self-jamming effect between said retainer, said headpiece, and said housing on impact of said piston hammer on said headpiece.

4. A percussive air tool comprising a hollow tubular housing having forward and rear end portions; a piston hammer disposed inside said housing for axial reciprocation therein, said piston hammer having a rear end chamber; an air distributing valve arranged in a rear end portion of said housing and received by said rear end chamber of said piston hammer; a headpiece fixedly secured in the forward end portion of said housing and mating therewith along its tubular surface, said headpiece being subjected to impact of said piston hammer;

a separate retainer having one end thereof received on and surrounding the forward end portion of said housng to raise its radial rigidity and strength, the other end of said retainer received on and surrounding said headpiece for rigidly mating said headpiece with said housing;

a self-jamming conical joint for interconnecting the forward end portion of said housing and said retainer, said self-jamming conical joint including an outer surface of said housing which is tapered toward the rear end portion of said housing, an inner surface on said retainer which is tapered toward the rear end portion of said housing for matingly engaging with said outer surface of said housing, an outer surface on said headpiece which is tapered toward the forward end portion of said housing, an inner surface on said retainer which is tapered toward the forward end portion of said housing and an intermediate conical bushing disposed between said retainer and said headpiece and matingly engaging with said forwardly tapered inner surface of said retainer and said outer surface of said headpiece, to clamp said housing between said retainer and said headpiece and to increase the self-jamming effect between the retainer, said headpiece, and said housing on impact of said piston hammer on said headpiece.

* * * * *